United States Patent [19]

Nederveld

[11] Patent Number: 4,949,898

[45] Date of Patent: Aug. 21, 1990

[54] PALLETIZED CONTAINER

[75] Inventor: Terrill L. Nederveld, Ada, Mich.

[73] Assignee: Packaging Corporation of America, Evanston, Ill.

[21] Appl. No.: 297,421

[22] Filed: Jan. 13, 1989

[51] Int. Cl.[5] ..... B65D 5/32

[52] U.S. Cl. ..... 229/117.02; 206/600; 229/23 R

[58] Field of Search ..... 220/415, 464, 468; 229/23 R, 41 R, 41 B, 117.02; 206/386, 600

[56] References Cited

U.S. PATENT DOCUMENTS

| | | | |
|---|---|---|---|
| 3,291,364 | 12/1966 | Fischer | 206/600 |
| 4,373,637 | 2/1983 | Shippell | 229/41 B |
| 4,691,859 | 9/1987 | Snyder | 229/23 R |
| 4,712,687 | 12/1987 | Silcott et al. | 206/600 |
| 4,760,922 | 8/1988 | Northgrave | 229/41 R |
| 4,793,507 | 12/1988 | Delplanque | 229/41 R |

FOREIGN PATENT DOCUMENTS

| | | | |
|---|---|---|---|
| 2604189 | 8/1977 | Fed. Rep. of Germany | 206/600 |
| 2480240 | 10/1981 | France | 206/600 |

*Primary Examiner*—Gary Elkins

*Attorney, Agent, or Firm*—Neuman, Williams, Anderson & Olson

[57] ABSTRACT

A palletized container is provided having a collapsible receptacle section supported and subtended by a pallet section. The receptacle section includes a plurality of foldably interconnected outer wall panels which, when in a set up mode, extend upright from the upper surface of the pallet section. When in a collapsed mode, the outer wall panels are disposed in stacked relation and overlie the pallet section upper surface. A selected first pair of outer wall panels is provided with each selected panel having a pair of complemental panel segments which are foldably interconnected. When the receptacle section is in the setup mode, each pair of complemental panel segments are disposed in coplanar relation and the selected first pair of outer wall panels are disposed in opposed upright relation. When the receptacle section is in a collapsed mode, the outer wall panels are disposed in stacked relation and overlie the pallet section upper surface.

12 Claims, 4 Drawing Sheets

FIG. 1
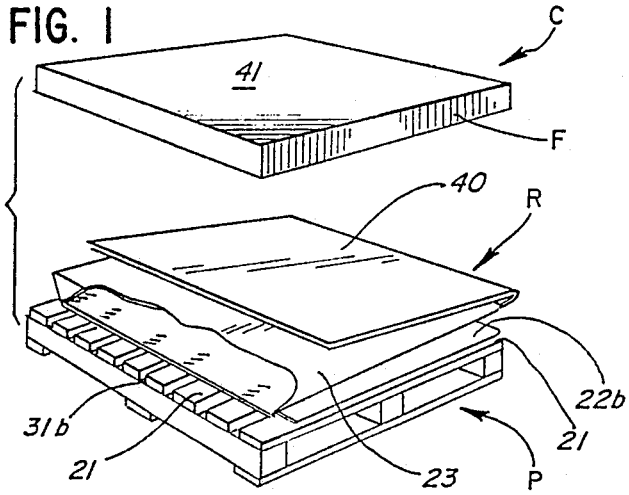
FIG. 2
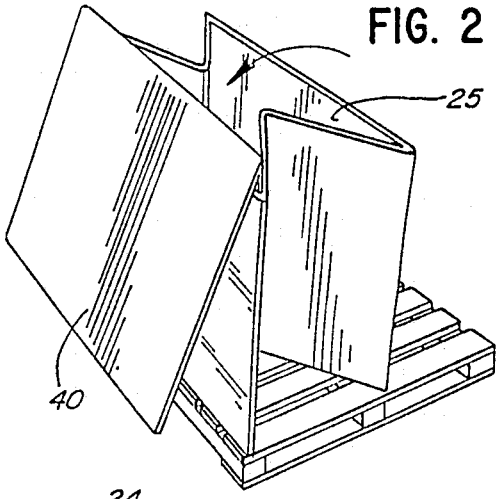
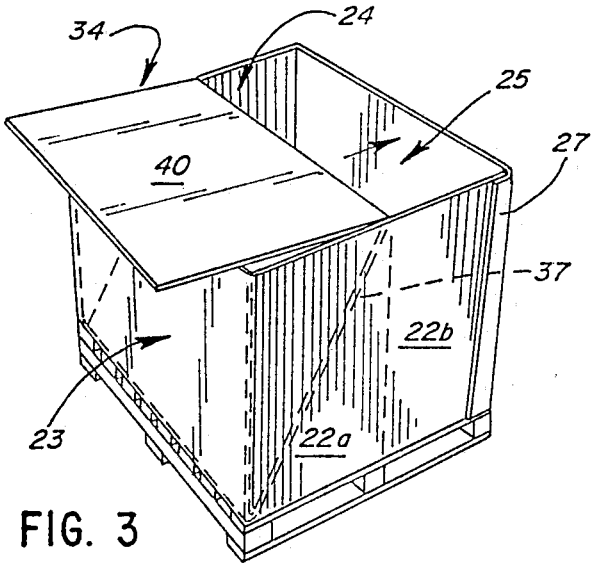
FIG. 3
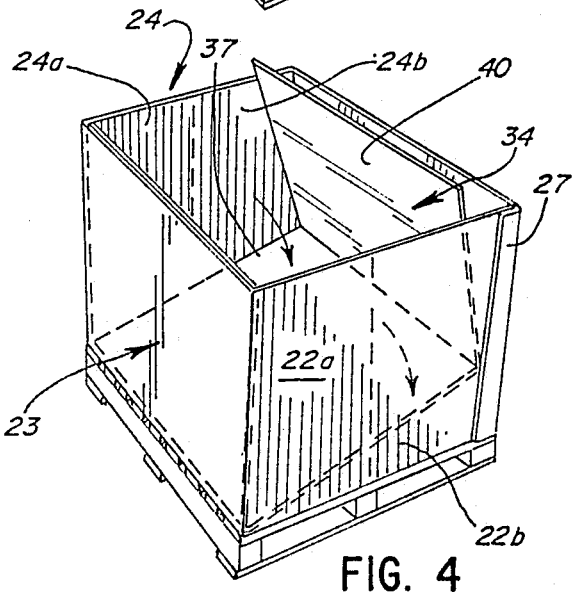
FIG. 4
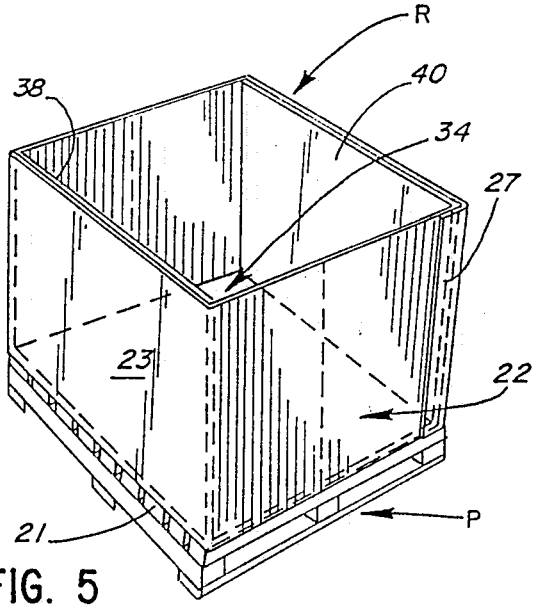
FIG. 5
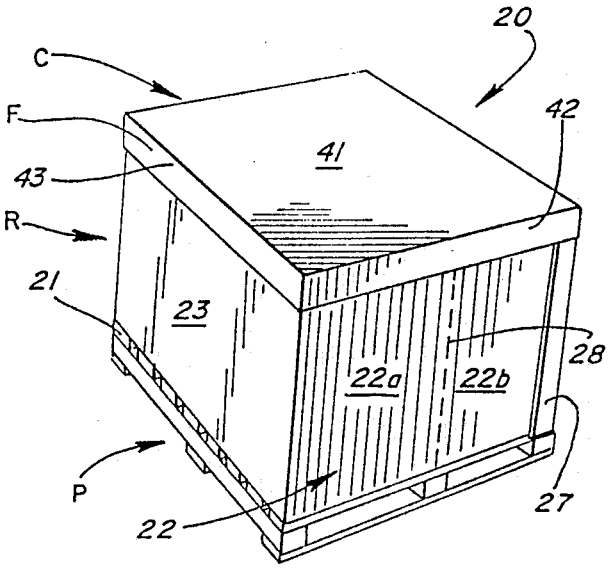
FIG. 6

FIG. 9
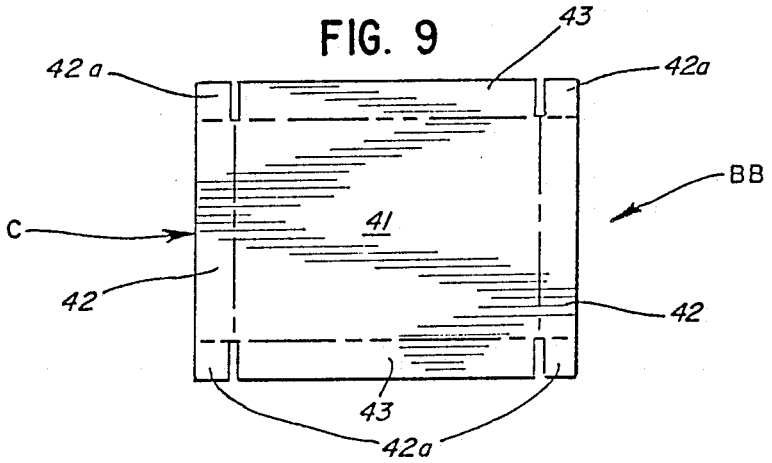
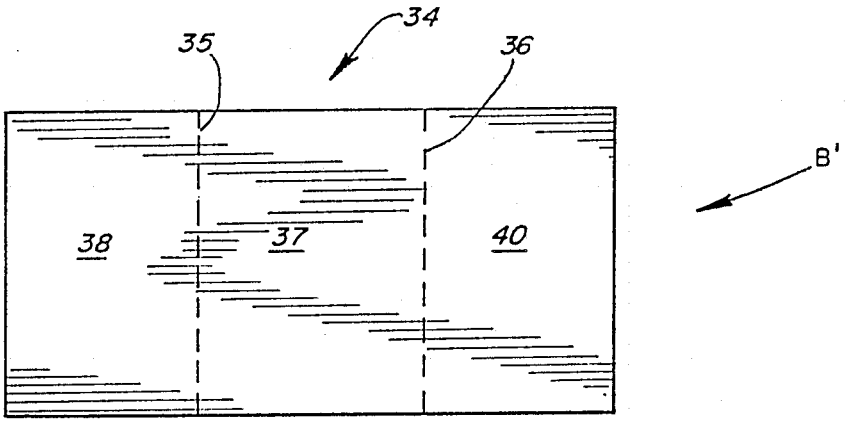
FIG. 8
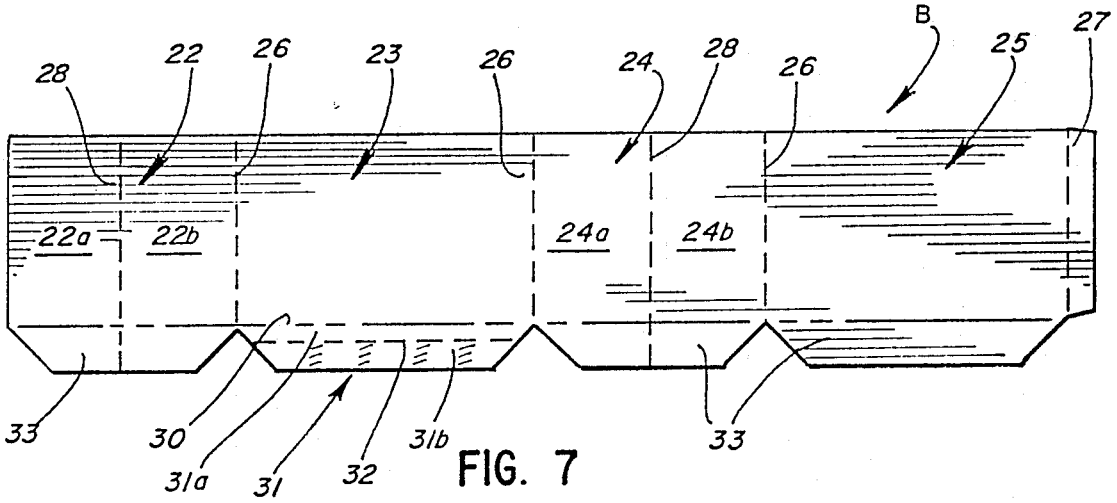
FIG. 7

PALLETIZED CONTAINER

Various palletized containers has heretofore been utilized; however, because of certain inherent design characteristics they have been beset with one more of the following shortcomings:a) they are of a complex, costly construction;b) they are difficult to set up, or collapse, requiring an inordinate amount of manual labor; c) when in a collapsed state, they do not form compact units which are suitable for storing with like units;d) they are not capable of accommodating a variety of products and e) they do not provide adequate protection for the accommodated product.

SUMMARY OF THE INVENTION

Thus, it is an object of the invention to provide an improved palletized container which is void of the aforenoted shortcomings associated with prior containers of this general type.

It is a further object to provide an improved palletized container comprising a minimum number of components which are easy to assemble.

It is a still further object to provide an improved palletized container which is reusable and readily collapsible for storage.

Further and additional objects will become apparent from the description, accompanying drawings and appended claims.

In accordance with one embodiment of the invention, a palletized container is provided having a receptacle section capable of assuming either a set up or collapsed mode, and a pallet section which subtends and supports the receptacle section. The receptacle section includes a plurality of foldably connected outer wall panels which are adapted to extend upwardly from the upper surface of the pallet section, when the receptacle section is in a set up mode. A selected first pair of outer wall panels are provided with foldably connected panel segments, the latter being in substantially coplanar relation when the receptacle section is in a set up mode; and being in face to face relation when the receptacle section is in a collapsed mode. An outer wall panel, intermediate the first pair of outer wall panels, is provided with a flap which is foldably connected to the bottom-forming edge thereof.

The flap is fixedly secured to the pallet section upper surface and adjacent the perimeter thereof. The receptacle section also includes an adjustable member formed of foldable sheet material. When the receptacle is in the set up mode, the adjustable member will span the distance between the selected first pair of outer wall panels and retain all the outer wall panels in an upright relation with respect to the pallet section upper surface.

DESCRIPTION

For a more complete understanding of the invention reference is made to the drawings wherein:

FIG. 1 is a fragmentary perspective view of one embodiment of the improved palletized container shown in a collapsed mode and with a cover section thereof in an elevated disengaged position.

FIGS. 2–5 are perspective views of the container of FIG. 1 showing the receptacle section thereof in successive stages of set up.

FIG. 6 is a perspective view of the container of FIG. 1 shown in a fully set up mode.

FIG. 7 is a top plan view of a blank for the outer wall panels of the receptacle section.

FIG. 8 is a top plan view of a blank for the adjustable member of the receptacle section.

FIG. 9 is a top plan view of a blank for the cover section.

Figure 10:
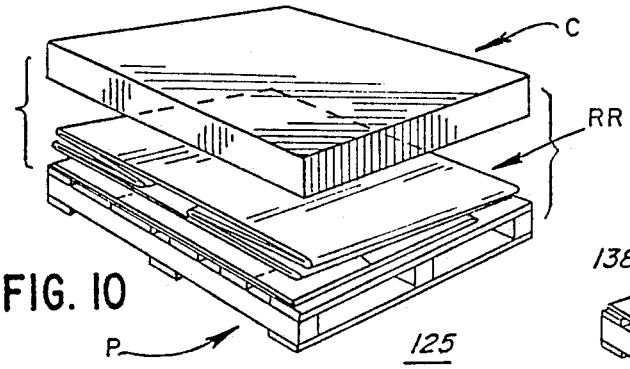
FIG. 10 is similar to FIG. 1 but showing a second embodiment of the improved palletized container.

Referring now to the drawings and more particularly to FIGS. 1–9, one embodiment of the improved palletized container 20 is shown. The container comprises a collapsible receptacle section R which is mounted on the upper surface 21 of a conventional pallet section P. The container 20 in a fully set up mode is shown in FIG. 6.

The receptacle section R, as illustrated, is formed from two blanks B (FIG. 7) and B' (FIG.) of foldable sheet material (e.g., double-faced or double-wall corrugated fiberboard). The sheet material may be treated so as to be substantially moisture resistant. Blank B includes a plurality (e.g. four) of outer wall panels, 22, 23, 24, and 25 which are arranged in side by side relation and interconnected by parallel foldline 26. A conventional manufacturer's glue flap 27 is foldably connected to the exposed edge of either panel 22 or 25. Panels 22 and 24 are provided with centrally disposed foldlines 28, each foldine 28 is in spaced parallel relation to an adjacent foldline 26. By reason of foldline 28, panel 22, 24 comprises a pair of panel segments *22a*;*24a–b* which are of like configuration.

Connected by foldline 30 to the lower or bottom-forming edge of panel 23 is an elongated flap 31 which extends substantially the distance between adjacent foldlines 26. Flap 31 is provided with a foldline 32 which is in spaced substantially parallel relation to foldline 30; thus, forming flap 31 into an inner segment **31*a* and an outer segment 31*b*. The remaining outer wall panels 22, 24 and 25 may have elongated tabs 33 foldably connected to the bottom-forming edges thereof. It will be noted in FIG. 7 that in each instance foldline 28 extends into the corresponding tab 33. The functions of flap 31 and tabs 33** will be described more fully hereinafter.

Blank B' defines an adjustable member 34 and includes a pair of spaced substantially parallel foldlines 35, 36, see FIG. 8. By reason of the foldlines 35, 36, blank B' is provided with a central bottom panel 37 and a pair of inner side panels 38, 40.

FIG. 9 shows a blank BB which forms a telescoping cover or lid section C. When the receptacle section R is in the collapsed mode, FIG. 1 the cover section C is sized so that it will overlie and conceal the collapsed outer wall panels as will be discussed more fully in the description to follow. The cover section C may be conventional design and includes a center panel 41 having a configuration corresponding substantially to the area defined by the upper edges of the outer wall panels, when the receptacle section is in the set up mode, see FIG. 5. The center panel 41 is delimited by two pairs of opposing foldable marginal flaps 42, 43. Each flap 42 is provided with a pair of foldable connecting flaps **42*a* which extend endwise therefrom. When the blank BB is set up to form the cover section C, the marginal flaps 42, 43 are folded so as to depend from the central panel and form a peripheral flange F which embraces the upper edge portions of the set up outer wall panels, see FIG. 6. The connecting flaps 42*a* are secured by adhesive, stitching or stapling to either the interior or exterior surface of an adjacent marginal flap 43 and thus, retain the flaps 42, 43** in their flange-forming positions.

In assembling the receptacle section R on the pallet section P, the outer segment **31*b* of flap 31 is fixedly secured to the upper surface of the pallet section by suitable fasteners (e.g. staples, nails, etc.). The outer segment 31*b* is positioned in close proximity and substantially parallel to one side edge of the upper surface. When the receptacle section R is in the set up mode, FIG. 5, outer wall panel 23 is in substantial vertical alignment with the adjacent side edge of the pallet section upper surface 21. The remaining outer wall panels 22, 24 and 25 are also in substantial vertical alignment with adjacent side edges of the upper surface 21**.

The central panel 37 of blank B' is configured so that when receptacle section R is in the set up mode, it will fully occupy the area defined by the set up outer wall panels 22–25. The side panels 38 and 40 of blank B' are disposed, respectively, in face to face relation with the interior surfaces of outer wall panels 23 and 25. Each side panel conforms substantially to the shape of the corresponding interior surface of the adjacent outer wall panel. Side panel 38 is preferably affixed to the interior surface of wall panel 23.

When receptacle section R is being adjusted from a set up mode, FIG. 5 to a collapsed mode, FIG. 1, the side panel 40 is pulled upwardly and out of the receptacle interior until it overlies the exterior surface of wall panel 23, see FIGS. 4, 3 and 2. When this occurs bottom panel 37 will assume a face to face engagement with the exposed interior surface of wall panel 23. In the illustrated embodiment the central panel 37 and the side panels 38 and 40 have substantially the same configuration and side panels 38 and 40 conform substantially to the shape of wall panels 23 and 25. Once the member 34 assumes the position shown in FIG. 2, the wall panels 22 and 24 can be pushed inwardly towards one another so that each panel will fold about its center foldline 38 causing the pair of panel segments **22*a*, 22*b* or 24*a*, 24*b* thereof to assume a substantially face to face relation. As this occurs, wall panel 25 will automatically move towards wall panel 23 thereby sandwiching the pairs of folded panel segments 22*a*, 22*b* and 24*a*, 24*b* and center panel 37 between wall panels 23 and 25. Once the panels and panel segments are in the aforedescribed sandwiched relation, they are pivoted as a unit about the foldline 32 formed in flap 31. The spacing between foldlines 30 and 32 compensated for the thicknesses of the sandwiched panels and panel segments, thereby allowing the panels and panel segments to assume a substantially flat overlying relation with respect the upper surface 21 of the pallet section P. Once the receptacle section R is in the collapsed mode, the wall panels and panel segments are concealed beneath a telescoping cover section C. As aforementioned the cover section is formed from a blank BB of conventional design, see FIG. 9**. Once the cover section C is in place, the collapsed container forms a compact structure which may be readily stored in such form or shipped to a customer for set up and loading.

Figure 17:
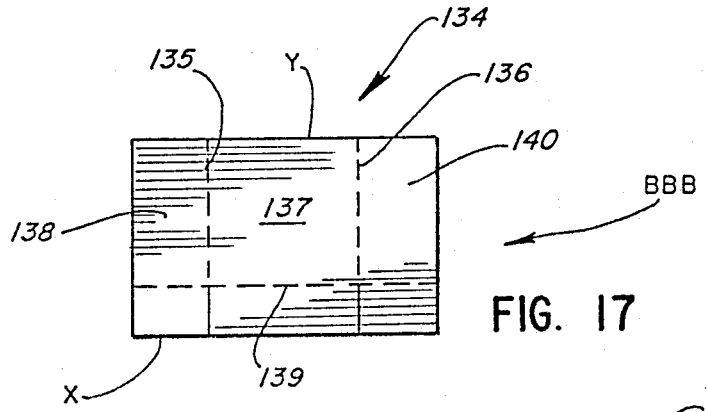
FIG. 17 is a top plan view of the adjustable member shown in FIGS. 11–14.

FIGS. 10–14 illustrate a second embodiment of the improved container 120 which includes a pallet section P, a receptacle section RR and a cover section C. The pallet section P and cover section C are preferably the same as the corresponding sections previously described with respect to container 20. Receptacle section RR may be formed in part from a blank B, shown in FIG. 7. In addition, receptacle section RR includes an adjustable member 134 formed from a blank BBB of foldable sheet material. Blank BBB, FIG. 17 includes a pair of spaced substantially parallel foldlines 135, 136 which cooperate to form a center panel 137 and a pair of side panels 138, 140 disposed on opposite sides of the center panel. In addition to foldlines 135, 136, a third foldline 139 is formed in the blank and extends across the side and center panels and is disposed substantially perpendicular to foldlines 135, 136. The foldline 139 is spaced from and substantially parallel to an edge X of the blank BBB.

Figure 14:
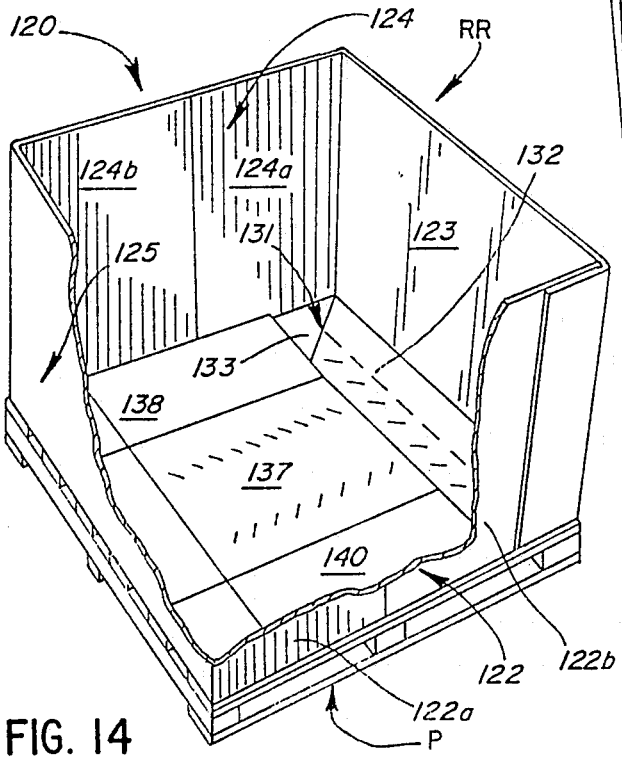
FIG. 14 is a fragmentary perspective view of the container of FIG. 10 with the receptacle section thereof in a set up mode and with portions of the outer wall panels at one corner cut away to show the relative disposition of the adjustable member.
Figure 15:
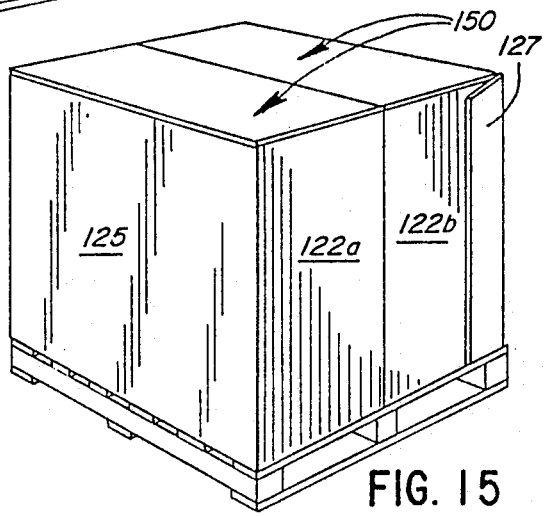
FIG. 15 is similar to FIG. 6 but showing a modified container in a fully set up mode.

When the receptacle section RR is in the set up mode, FIG. 14, the center and side panels 137, 138 and 140 of the adjustable member 134 are in substantially coplanar relation and span the distance between wall panels 122, 124 so as to maintain the latter in upright substantially parallel opposed relation, see FIG. 14. The distance between edges X and Y of blank BBB equals substantially the spacing between upright wall panels 123 and 125 minus the width of flap 131 measured perpendicular to the foldline connecting the flap to the bottom forming edge of wall panel 123.

When assembling the adjustable member 134 and the folded blank B on the pallet section P, the flap 131 is first secured to the upper surface 21 of the pallet section in the same manner and location as previously discussed with respect to container 20. The adjustable member 134 is then positioned on the pallet section upper surface so that the edge Y of blank BBB is disposed in close proximity to, or abutting, the distal edge of flap 131, see FIG. 14. The center panel 137 of the blank is then secured by staples, adhesive or the like to the pallet upper surface. Only the portion of the center panel 137 between edge Y and foldline 139 is secured to the upper surface while the remainder of the blank is free to assume various folded positions as the receptacle section RR is being set up or collapsed, see FIGS. 11–13.

Figure 11:
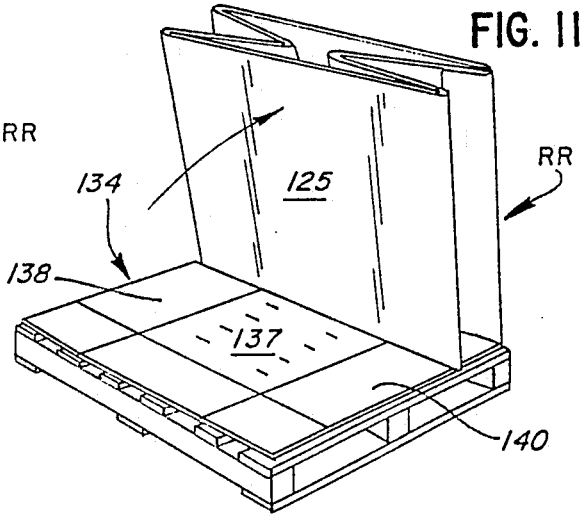
FIGS. 11–13 are perspective views of the container of FIG. 10 showing the receptacle section thereof in successive stages of set up.
Figure 12:
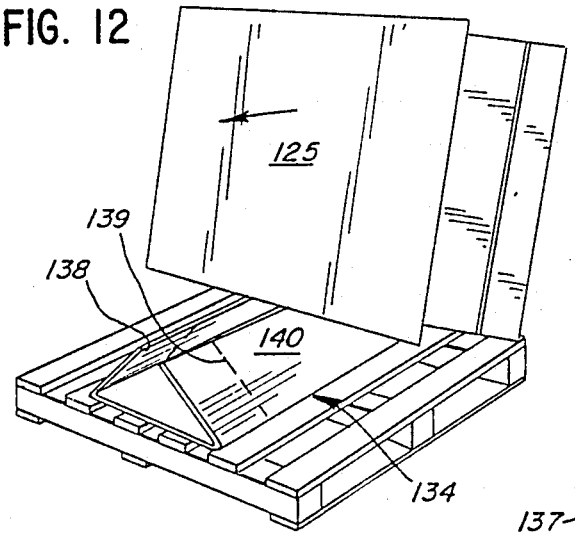
Figure 13:
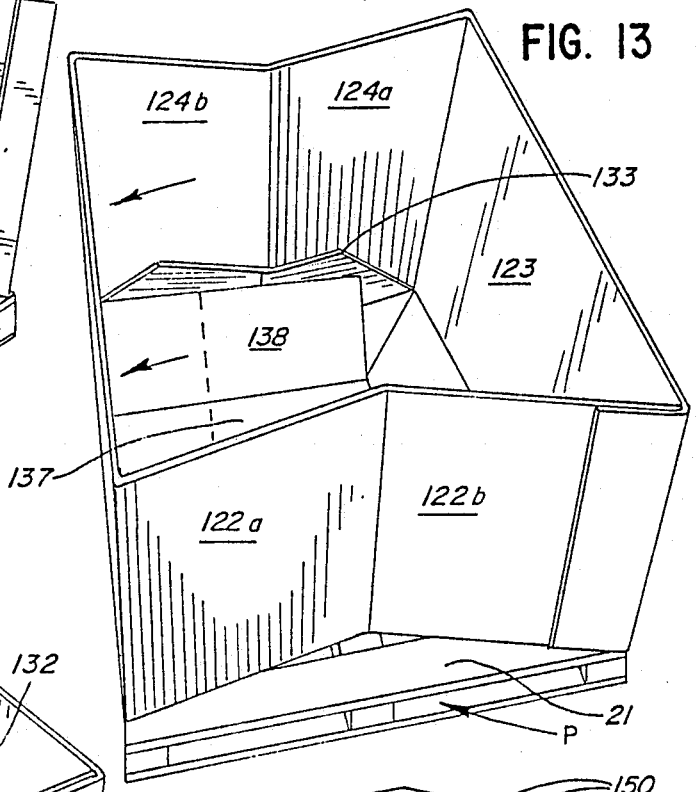

When setting up receptacle section RR from its collapsed mode, FIG. 10, the cover section C is removed whereupon the stacked panels and panel segments are pivoted as a unit to a substantially upright position, FIG. 11. Once the panels and panel segments are in the upright position, FIG. 11, the side panels 138, 140 of member 134 are folded upwardly about foldlines 135, 136 so as to partially overlap center panel 137, see FIG. 12. The portions of the side panels 138, 140 and center panel between edge X and foldline 139 are then folded upwardly a small amount prior to outer wall panel 125 being pulled away from wall panel 123. By reason of the adjustable member 134 being initially folded as indicated, the tabs 133 foldably connected to the bottom-forming edges of wall panels 122, 124 and 125 can be readily folded so as to overlie the pallet section upper surface 21. Once the wall panels are set up so that each pair of panel segments 122*a*, 122*b* and 124*a*, 124*b* are in coplanar relation and the tabs are overlying the upper surface, the side panels 138, 140 of member 134 are unfolded so as to assume a coplanar relation with center panel 137. Upon the side and center panels assuming the coplanar relation, the tabs 133 are captured between the member 134 and the pallet section upper surface thus, enhancing the stability of the upright outer wall panels. As the set up receptacle section is filled with product, the aforementioned captured tabs will remain in place.

Figure 16:
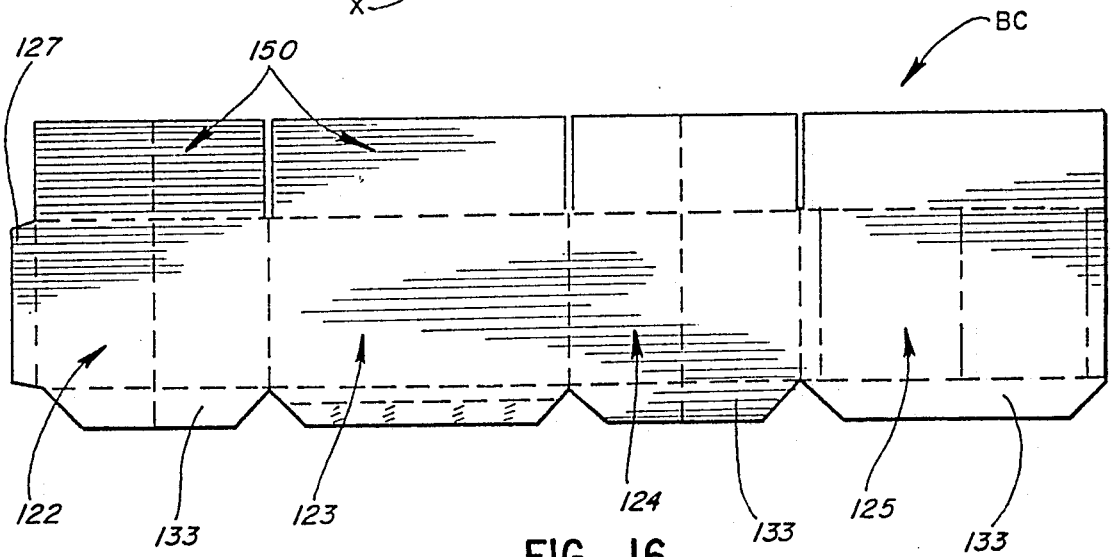
FIG. 16 is similar to FIG. 7 but of a modified form of blank.

FIG. 16 illustrates a modified blank BC which is similar to blank B, FIG. 7, except top closure flaps 150 are foldably connected to the top-forming edges of the outer wall panels 122–125. By reason of the top closure flaps 150, the telescoping cover section C may be eliminated.

Figure 18:
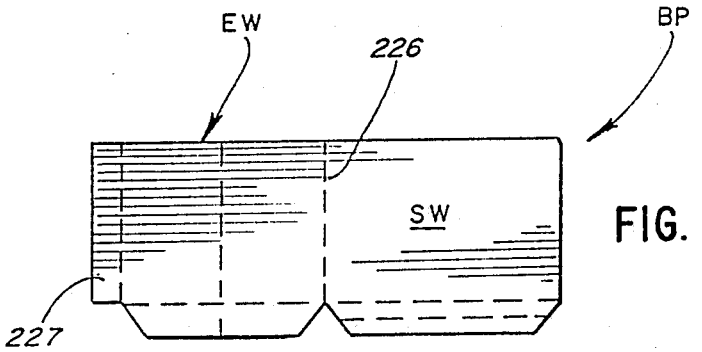
FIG. 18 is a top plan view of one of a pair of modified blanks for forming the wall panels and flap of a receptacle section.

In place of having a single blank B or BC from which the outer wall panels are formed, a pair of separate blanks BP, only one being shown in FIG. 18, may be utilized. Each blank BP is of like construction and includes only two outer wall panels, one a side wall SW, and the other an end wall panel EW which are interconnected by a foldline 226. Side wall panels SW may have a configuration similar to that of wall panel 23, 123, 25 or 125 and end wall panel EW may have a configuration like that of wall panel 22, 122, 24 or 124. Each blank BP also includes a conventional manufacturer's glue flap 227 foldably connected to a corresponding side edge of the blank.

It is preferred that the outer wall panels of the receptacle section have a height such that when the receptacle section is in the collapsed mode, no portion of the wall panels will protrude outwardly beyond the perimeter of the pallet section upper surface.

Thus, the improved container is of simple, inexpensive, yet sturdy construction, and may readily and expeditiously be set up or collapsed with a minimum amount of manual effort and without the need for special tools or fixtures. When in a collapsed mode, the container forms a flat, compact structure suitable for storage and/or return shipping for reuse.

I claim:

1. A palletized container comprising a collapsible receptacle section supported and subtended by an upper surface of a pallet section; said receptacle section including a plurality of foldably interconnected pairs of outer wall panels adapted to extend upright from the pallet section upper surface when said receptacle section is in a set up mode, a first pair of outer wall panels being disposed in opposed relation, each panel of said first pair being provided with a pair a complemental panel segments foldably interconnected and adapted to assume a substantially planar relation when said receptacle section is in the set up mode, and to assume a folded substantially face to face relation intermediate a second pair of outer wall panels when said receptacle section is in a collapsed mode and overlying said pallet section upper surface, one panel of the second pair being provided with a flap foldably connected to a bottom-forming edge thereof and fixedly secured to the upper surface of the pallet section adjacent a perimeter thereof, and adjustable means, when in one position of adjustment, coacting with said receptacle wall panels to effect retention thereof in said set up mode; said receptacle section, when in the collapsed mode, having the outer wall panels thereof disposed in substantially overlying stacked relation with respect to the pallet section upper surface and substantially disposed within the perimeter of the pallet section upper surface.

2. The palletized container of claim 1 wherein the flap foldably connected to the bottom-forming edge includes an outer segment and an inner segment interconnected thereto by a first foldline disposed in spaced substantially parallel relation to a second foldline connecting the flap to said bottom-forming edge, said inner segment being intermediate said first and second foldlines and said outer segment being fixedly secured to the pallet section upper surface; a width dimension of said inner segment measured perpendicular to said first and second foldlines being substantially equal to a sum of thicknesses of the stacked outer wall panels measured perpendicular to the pallet section upper surface whereby said inner segment is disposed substantially perpendicular to the upper surface when the receptacle section is in the collapsed mode.

3. The palletized container of claim 1 wherein the flap and all of the outer wall panels of the receptacle section are formed from a first blank of foldable sheet material, and the adjustable means of said receptacle section is formed from a second blank of foldable sheet material.

4. The palletized container of claim 1 wherein the adjustable means of the receptacle section includes a bottom panel spanning the distance between the second pair of opposed outer wall panels when the receptacle section is in the setup mode; and a pair of inner wall panels foldably connected to opposite perimetric segments of the bottom panel, each inner wall panel being in face to face relation with an interior surface of a corresponding outer wall panel of the second pair when the receptacle section is in the setup mode.

5. The palletized container of claim 4 wherein one inner wall panel of the adjustable means is affixed to the interior surface of a corresponding second pair outer wall panel.

6. The palletized container of claim 5 wherein the second pair outer wall panel to which the one inner wall panel of the adjustable means is affixed is disposed opposite the outer wall panel having the foldable flap when the receptacle section is in the setup mode.

7. The palletized container of claim 4 wherein each inner wall panels of the adjustable means has a configuration substantially the same as the configuration of the interior surface of the corresponding second pair outer wall panel.

8. The palletized container of claim 5 wherein the one inner wall panel of the adjustable means and the corresponding second pair outer wall panel to which it is affixed are sandwiched between the bottom panel and the other inner wall panel of the adjustable means when the receptacle section is in the collapsed mode.

9. The palletized container of claim 1 wherein a first predetermined number of outer wall panels are formed from one of a pair of complemental first blanks of foldable sheet material, and a second predetermined number of outer wall panels are formed from a second of said pair of first blanks, and the adjustable means is formed from a second blank of foldable sheet material.

10. The palletized container of claim 9 wherein each first blank has substantially the same configuration.

11. The palletized container of claim 1 or 2 wherein the adjustable means includes a central panel which is fixedly secured to the pallet section upper surface and a pair of foldable side panels disposed on opposite sides of said central panel; when the receptacle section is in the setup mode, the central and side panels are in substantially coplanar relation and substantially span the distance between the first pair of outer wall panels.

12. The palletized container of claim 11 wherein the central and side panels of the adjustable means include a common foldline spaced from a corresponding edge of said central and side panels and angularly disposed relative to axes about which said side panels fold with respect to said central panel.

* * * * *